US009190755B2

(12) United States Patent
Hsu et al.

(10) Patent No.: US 9,190,755 B2
(45) Date of Patent: Nov. 17, 2015

(54) ELECTRCIAL CONNECTOR WITH IMPROVED FEATURE GOOD TO AUTOMATIC MASS PRODUCTION

(71) Applicant: HON HAI PRECISION INDUSTRY CO., LTD., New Taipei (TW)

(72) Inventors: Kuo-Chun Hsu, New Taipei (TW); Zu-Sheng Wang, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 82 days.

(21) Appl. No.: 14/162,764

(22) Filed: Jan. 24, 2014

(65) Prior Publication Data

US 2014/0213091 A1 Jul. 31, 2014

(30) Foreign Application Priority Data

Jan. 31, 2013 (CN) ..... 2013 1 0037977

(51) Int. Cl.

| | |
|---|---|
| ***H01R 12/00*** | (2006.01) |
| ***H01R 12/72*** | (2011.01) |
| ***H01R 13/502*** | (2006.01) |
| ***H01R 13/6581*** | (2011.01) |

(52) U.S. Cl.
CPC ..... *H01R 12/724* (2013.01); *H01R 13/502* (2013.01); *H01R 13/6581* (2013.01)

(58) Field of Classification Search
CPC . H01R 12/724; H01R 13/6581; H01R 13/502
USPC ..... 439/79, 701
See application file for complete search history.

(56) References Cited

U.S. PATENT DOCUMENTS

| | | | | |
|---|---|---|---|---|
| 5,816,829 | A | 10/1998 | Chiang | |
| 8,870,606 | B2 * | 10/2014 | Yu et al. | 439/701 |
| 9,017,108 | B2 * | 4/2015 | Suemitsu | 439/701 |
| 9,022,813 | B2 * | 5/2015 | Wilkner | 439/701 |

FOREIGN PATENT DOCUMENTS

| | | |
|---|---|---|
| CN | 1227438 | 9/1999 |
| CN | 201303173 | 9/2009 |
| CN | 201616522 | 10/2010 |
| CN | 201690033 | 12/2010 |
| CN | 202025902 | 11/2011 |
| CN | 202189950 | 4/2012 |
| TW | M377724 | 4/2010 |
| TW | M39306 | 11/2010 |
| TW | M443299 | 12/2012 |
| TW | M443957 | 12/2012 |

* cited by examiner

*Primary Examiner* — Khiem Nguyen
(74) *Attorney, Agent, or Firm* — Wei Te Chung; Ming Chieh Chang

(57) ABSTRACT

An electrical connector includes an insulating seat and a terminal module embedded with a plurality of first terminals. The terminal module includes an insulating body, the first terminals includes body portions embedded in the insulating body, mating portions extending from the body portions and leg portions extending from the insulating body. The insulating body integrally defines mound portions snugly surrounding the leg portions one by one at a joint of the insulating body and the leg portions.

6 Claims, 5 Drawing Sheets

ELECTRCIAL CONNECTOR WITH IMPROVED FEATURE GOOD TO AUTOMATIC MASS PRODUCTION

BACKGROUND OF THE INVENTION

1. Field of the Invention

The present invention relates generally to an electrical connector with an improved feature which is adapted for automatic mass production.

2. Description of Related Art

Taiwan Utility patent issued No. M393061 discloses an electrical connector, which comprises a first insulating housing molded with first terminals and a second insulating housing molded with second terminal. In automatic production, the terminals are positioned in mold core and cavity by sliders, sometimes it is difficult to accurately guide the terminals into the mold cavity.

Hence, an improved electrical connector is desired.

SUMMARY OF THE INVENTION

Accordingly, an object of the present invention is to provide an electrical connector comprises an insulating seat and a terminal module embedded with a plurality of first terminals. The terminal module comprises an insulating body, the first terminals comprise body portions embedded in the insulating body, mating portions extending from the body portions and leg portions extending from the insulating body. The insulating body integrally defines mound portions snugly surrounding the leg portions one by one at a joint of the insulating body and the leg portions.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
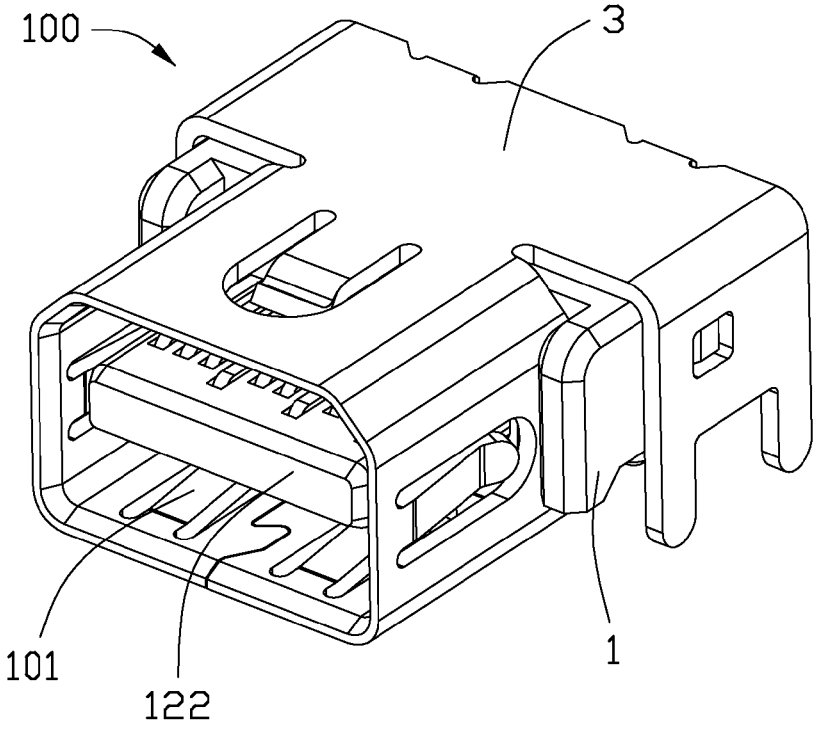
FIG. 1 is a perspective view showing an electrical connector in accordance with the present invention.
Figure 2:
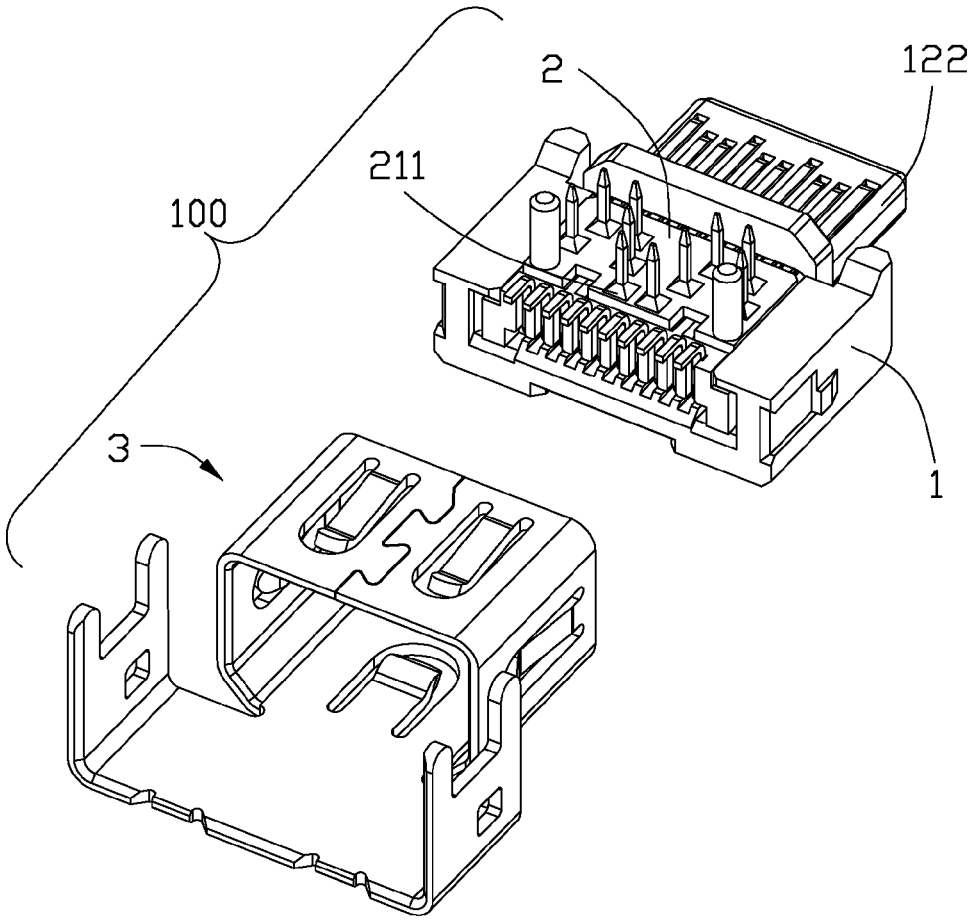
FIG. 2 is an exploded perspective view of the electrical connector.

Referring to FIGS. 1-2 illustrating an electrical connector 100, the electrical connector 100 which is adapted for automatic mass production. The electrical connector 100 includes an insulating seat 1, a terminal module 2 retained with the seat and a shielding shell 3 surrounding the seat to define a mating cavity 101. A mating tongue 122 extends into the mating cavity 101, so that the mating cavity 101 is intend to be inserted with a mating connector (not shown).

Figure 3:
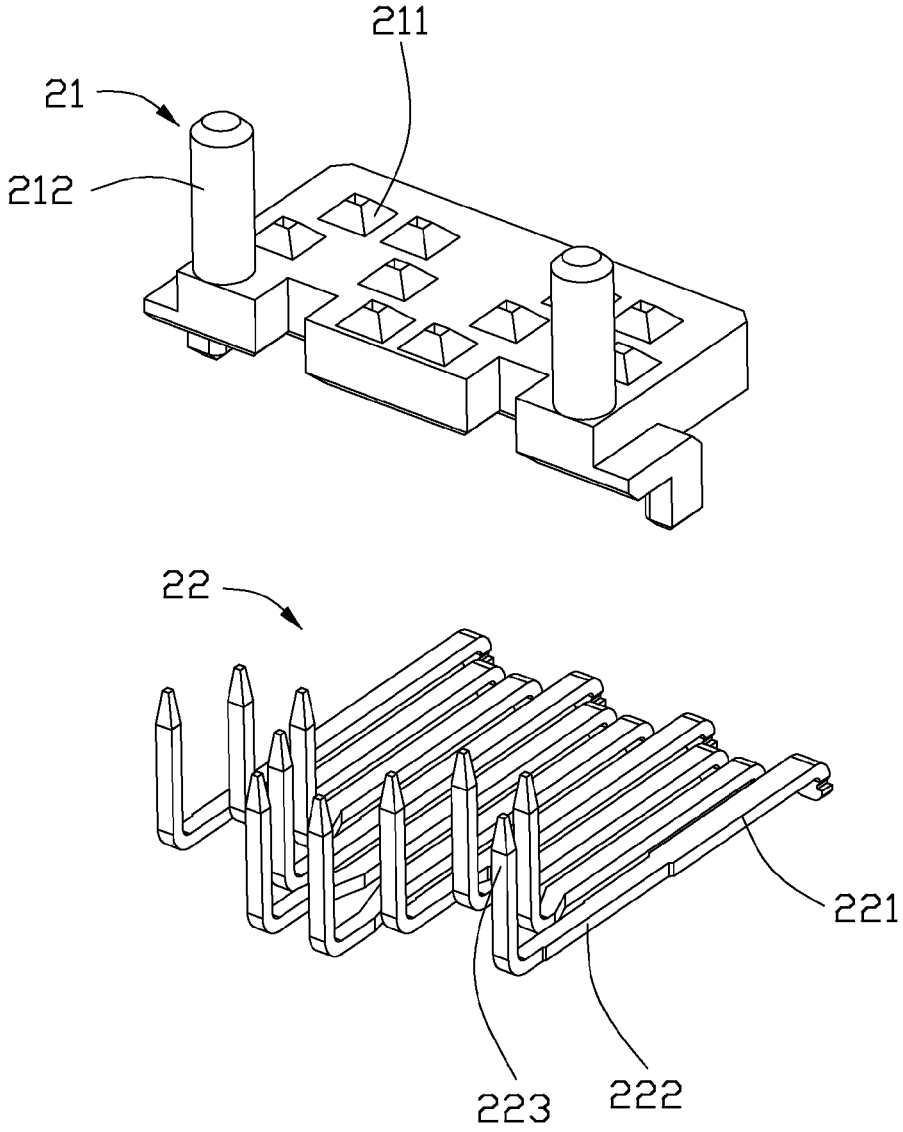
FIG. 3 is an exploded perspective view of a terminal module of the electrical connector.

Referring to FIG. 3, the terminal module 2 comprises a row of first terminals 22 and an insulating body 21 which is injection molded with the first terminals 22. The insulating body 21 is in a board shape and defines two guiding posts 212 projecting downwards from a bottom face thereof. Combination with FIG. 4, the first terminals 22 comprises plate body portions 222 embedded in the insulating body 21, plate mating portion 221 extending from a front end of the insulating body 21 and leg portions 223 extending from a rear end of the insulating body 21. The mating portions 221 are disposed parallel to the insulating body 21 and the leg portions 223 are disposed perpendicularly to the insulating body 21.

Figure 4:
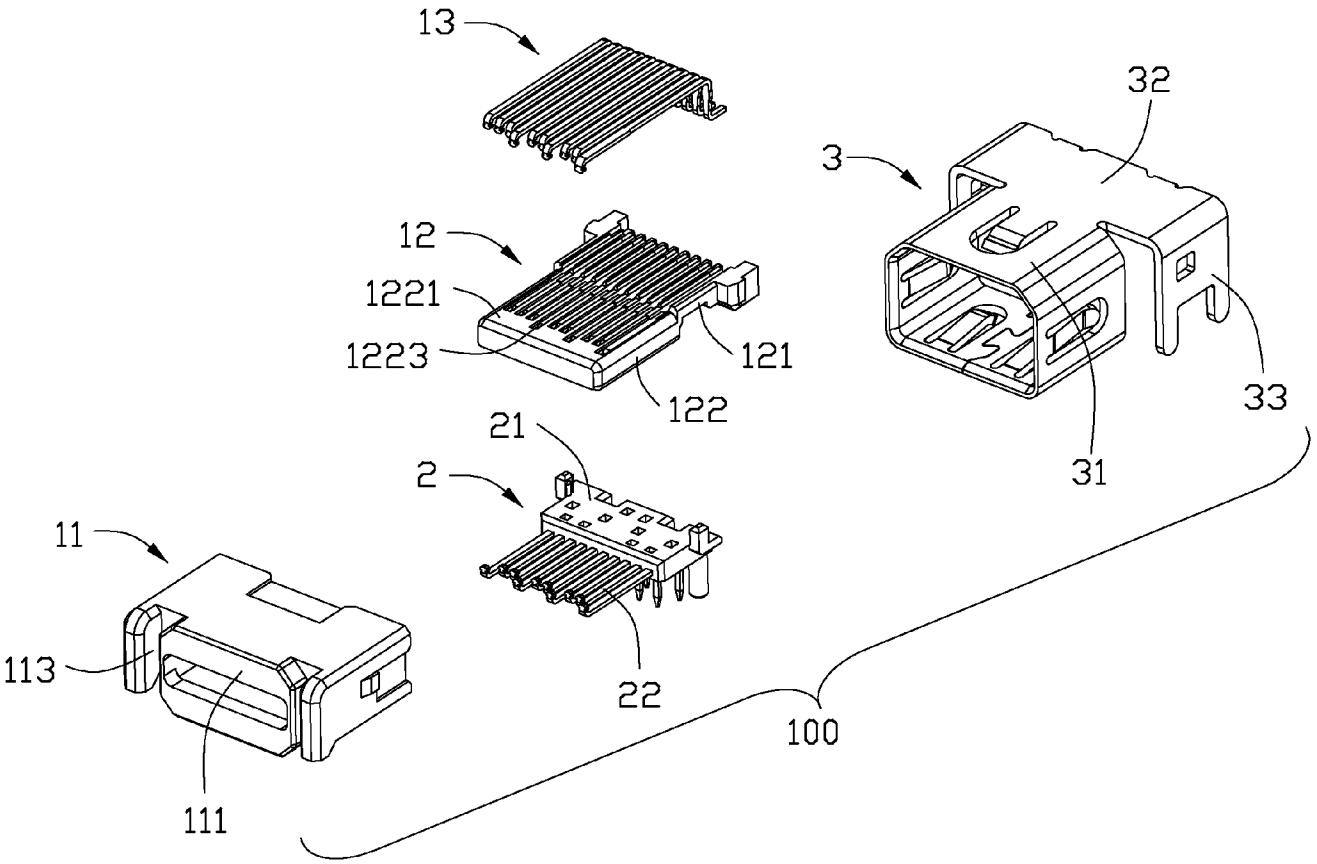
FIG. 4 is a front and top exploded perspective view of the electrical connector.
Figure 5:
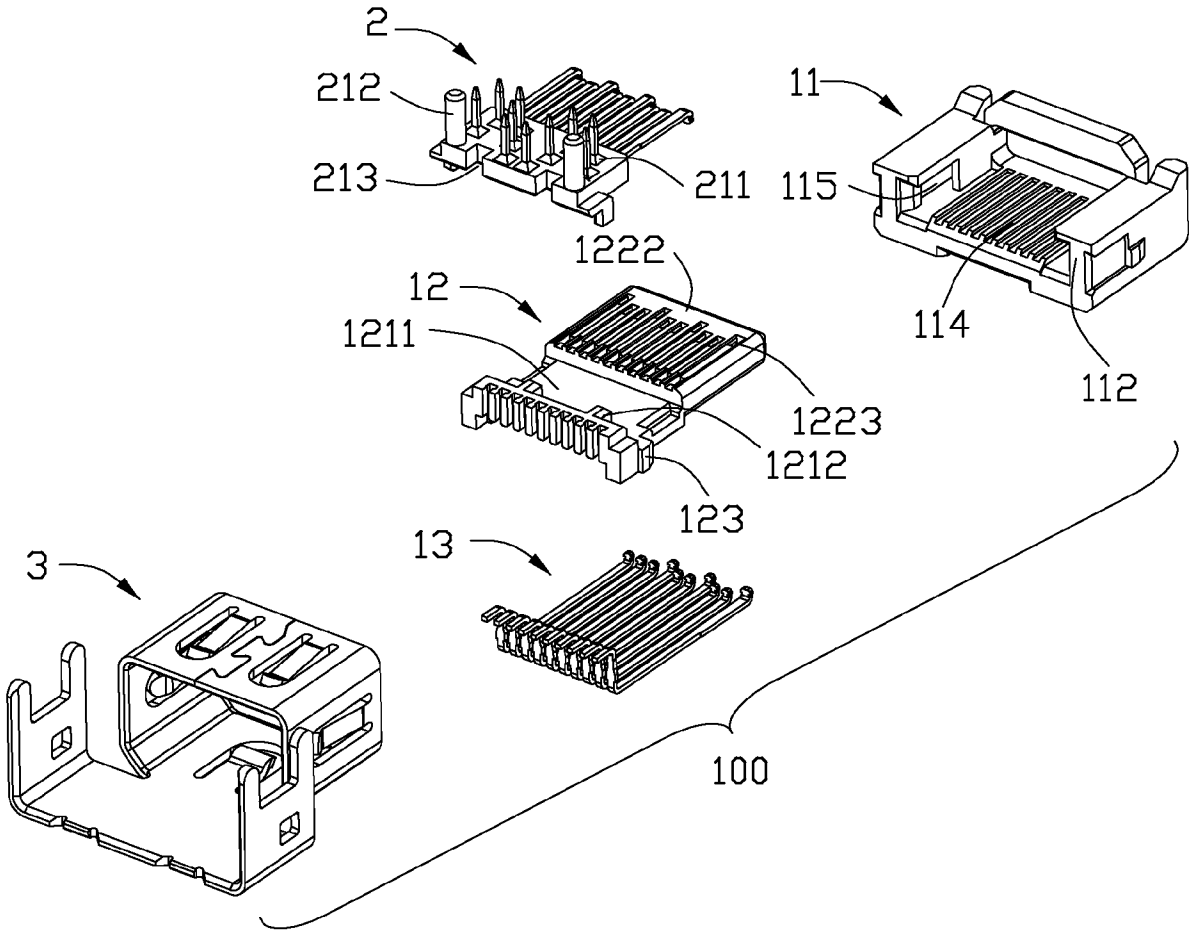
FIG. 5 is a front and bottom exploded perspective view of the electrical connector.

Referring to FIGS. 3 and 4, the insulating seat 1 comprises a base member 11 and a tongue member 12 discrete from the base member 11. The base member 11 defines a front face 111 and a rear face 112, and the front face defines a pair of locking slots 113 running through top and bottom faces of the base member 11 at opposite ends thereof. The base member 11 defines a receiving cavity 114 opening through the bottom face and the rear face 112 thereof and retaining slots 115 at opposite sides of the receiving cavity 114. The tongue member 12 comprises a base 121, said mating tongue 122 extending forward from the base 121. The mating tongue 122 defines a first face 1221 and a second face 1222 opposite to the first face 1221, a plurality of grooves 1223 is disposed on the first and second faces. The base 121 defines a shallow recess 1211 on the second face 1222 and two ribs 1212 extend forward in the shallow recess 1211. The tongue member 12 further defines blocking projections 123 at rear sides thereof, which are used to be engaged with the retaining slots 115.

The tongue member 12 is loaded with a row of second terminals 13, that is to say, the second terminals 13 are arranged on the grooves 1223 of the first face 1221 of the mating tongue 122. The second terminals 13 comprises body portions in the base 121 of the tongue member 12, mating portions extending in the mating tongue 122 and leg portions from the tongue member 12. The terminal module 2 is fitly retained in the second face of the tongue member 12, the insulating body 21 is fit in the shallow recess 1211 of the base 121 with the ribs 1212 fitly retained in the slots 213 defined at a rear of the terminal module 2. Therefore, the mating portions 221 of the first terminals 22 are arranged on the mating tongue 122, i.e., the mating portions 221 are retained in the grooves 1223 on the second face 1222 of the mating tongue 122 while the mating portions of the second terminals 22 are disposed on the first face 1221.

The leg portions 223 of the first terminals 22 are through-hole type and the leg portions of the second terminals 13 are SMT type. The leg portions 223 of the first terminals 22 are arranged in three rows and the second row of the leg portions are offset from each other along a front and rear direction. The leg portions of the second terminals are disposed at outer side of the leg portions 223 of the first terminals 22.

Said insulating body 21 has mound portions 211 integrally with the insulating body 21, which snugly surround the leg portions 223 of the first terminals one by one. Each leg portion 223 is surrounded with one mound portion 211 at the joint of the leg portion 223 and the insulating body 21. The leg portions 223 of the first terminals extend from a bottom face of the insulating body, the mound portions 211 integrally projecting downwards from the bottom face and each leg portion elbow through corresponding one mound portion 211. The mound portions 223 are in an inverted quadrilateral pyramid shape. The mound portions 211 are formed during the injection molding process of the terminal module 2. Mold core defines recesses (not shown) to guide an accurate insertion of the terminals and plastic material is injected in the mold core and the recess. After the mold core is taken away when the plastic material is cool, the mound portions are formed and reminded with the insulating body 21. Automatic mass production of the terminal module 2 benefit from said manufacture method. The mound portions might be other shapes.

Referring to FIGS. 1 and 4, the shielding shell 3 comprises a first main body 31 and a second main body 32, the first main body 31 bends and surrounds the seat 1 to define said mating cavity 101. The rear end of the first main body 31 is retained with locking slots 113 defined on the body 11 and the front of the first main body 31 surrounds the mating tongue 122. The second main body 32 cover on the top face of the base member 11 of the seat 1 and two soldering legs 33 bend downward from the second main body 32 and cover on the sides of the base member 11.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector comprising: an insulating seat; a terminal module embedded with a plurality of first terminals, the terminal module comprising an insulating body, the first terminal comprising body portions embedded in the insulating body, mating portions extending from the body portions and leg portions extending from the insulating body; wherein the insulating body integrally defines mound portions snugly surrounding the leg portions one by one at a joint of the insulating body and the leg portions, wherein each of the mound portions is in an inverted pyramid shape, wherein the insulating body is in a board shape, the mating portions of the first terminals are parallel to the insulating body and the leg portions of the first terminals are perpendicular to the insulating body, wherein the insulating seat is surrounded with a shielding shell to define a mating cavity and a mating tongue projects in the mating cavity, the mating portions of the first terminals are arranged along the mating tongue, wherein the insulating seat comprises a base member and a tongue member, the tongue member comprises a base and said mating tongue, the insulating body of the terminal module is retained in the base of the tongue member and the mating portions of the first terminals projecting from the insulating body and arranged along the mating tongue, the tongue member is retained in the base member and the shielding shell is retained on the base member and surrounding said mating tongue.

2. The electrical connector as described in claim 1, wherein the tongue member is loaded with a plurality of second terminals, the second terminals comprises body portions retained in the base of the tongue member, mating portions arranged along the mating tongue and leg portions from the tongue member, the leg portions of the second terminals are located at an outer side of that of the first terminals.

3. The electrical connector as described in claim 2, wherein the shielding shell comprises a first main body surrounding the mating tongue and a second main body retained on the base member of the insulating seat, the base member defines a front face and two locking slots recessed at the front face, two lateral rear sides of the first main body is retained in the locking slots.

4. The electrical connector as described in claim 3, wherein the base member define a rear face and a receiving cavity opening through the rear face and a bottom face thereof, the receiving cavity defines retaining slots at sides thereof and the base of the tongue member is received in the receiving cavity and defines blocking projections retained in the retained slots.

5. An electrical connector comprising; a terminal module including an insulative body with a plurality of terminal embedded therein, each of said terminal defining a contacting section exposed upon a mating port of said electrical connector, and a connecting section extending downwardly out of a bottom face of the insulative body, wherein the insulative body defines unitarily a plurality of downwardly tapered mound portions through which the corresponding connecting sections of the terminals downwardly extend, respectively, further including an insulative tongue member stacked upon the insulative body with the connecting sections of the terminals exposed upon one surface of said tongue member, further including a plurality of contacts assembled upon another surface of the tongue member opposite to said surface, further including an insulative housing into which both said tongue member and said insulative body are assembled, further including a metallic shell into which said housing is received.

6. The electrical connector as claimed in claim 5, wherein each of said mound portions defines a horizontal circular cross-section.

* * * * *